US006431829B1

(12) United States Patent
Watanabe et al.

(10) Patent No.: US 6,431,829 B1
(45) Date of Patent: Aug. 13, 2002

(54) TURBINE DEVICE

(75) Inventors: Hiroyoshi Watanabe; Hideomi Harada, both of Fujisawa (JP)

(73) Assignee: Ebara Corporation, Tokyo (JP)

( * ) Notice: Subject to any disclaimer, the term of this patent is extended or adjusted under 35 U.S.C. 154(b) by 0 days.

(21) Appl. No.: 09/587,554

(22) Filed: Jun. 5, 2000

(30) Foreign Application Priority Data

Jun. 3, 1999 (JP) ..... 11-156214

(51) Int. Cl.[7] ..... F04D 29/44
(52) U.S. Cl. ..... 415/189; 415/191
(58) Field of Search ..... 415/189, 191, 415/192

(56) References Cited

U.S. PATENT DOCUMENTS 3,989,406 A * 11/1976 Bliss ..... 415/181
5,249,922 A * 10/1993 Sato et al. ..... 415/191
5,342,170 A * 8/1994 Elvekjaer et al. ..... 415/191
5,616,000 A * 4/1997 Yamada et al. ..... 415/191
5,641,268 A * 6/1997 Martin et al. ..... 415/191
6,109,869 A * 8/2000 Maddaus et al. ..... 415/191

FOREIGN PATENT DOCUMENTS

| | | |
|---|---|---|
| JP | 57-171006 | 10/1982 |
| JP | 59-44482 | 10/1984 |
| JP | 8-93404 | 4/1996 |
| JP | 8-218803 | 8/1996 |

OTHER PUBLICATIONS

H. Watanabe & H. Harada, "Suppression of Secondary Flows in a Trubine Nozzle with Controlled Stacking Shape and Exit Circulation by 3D Inverse Design Method", ASME Paper 99–GT–72, Jun. 7– Jun. 10, 1999.

* cited by examiner

*Primary Examiner*—John Kwon
(74) *Attorney, Agent, or Firm*—Armstrong, Westerman, & Hattori, LLP

(57) ABSTRACT

A turbine device includes a rotor having a plurality of turbine blades disposed between an inner-diameter surface and an outer-diameter surface. The turbine blades are of a front or intermediate loaded type near the inner-diameter surface and of a rear loaded type near the outer-diameter surface.

6 Claims, 14 Drawing Sheets

INVENTIVE BLADES

INVENTIVE BLADES

CONVENTIONAL BLADES

TURBINE DEVICE

BACKGROUND OF THE INVENTION

1. Field of the Invention

The present invention relates to a turbine device for use in a power generation plant or the like.

2. Description of the Related Art

Gas turbines and steam turbines have been used to convert the thermal energy of high-temperature gases and steam into mechanical power or electric power. In recent years, it is very important for turbine manufacturers to increase the performance of turbines as energy transducers for preventing energies from being exhausted and also preventing the global warming on the earth.

High- and medium-pressure turbines have a relatively small ratio of the blade height to the inner diameter of the turbine. Therefore, these turbines suffer a large loss due to a secondary flow because of a large effect of a region referred to as a boundary layer where the energy of a fluid developed on inner- and outer-diameter surfaces of the turbine is small. The mechanism of generation of the secondary flow is as follows:

As shown in FIG. 1 of the accompanying drawings, a flow G flowing into a space between two adjacent rotor blades 1 is subjected to a force caused by a pressure gradient from a pressure surface F of one of the rotor blades 1 toward a suction surface B of the other rotor blade 1. In a main flow spaced from an inner-diameter surface L and an outer-diameter surface M (hereinafter referred as to hub endwall and tip endwall), the force caused by the pressure gradient and a centrifugal force caused by the deflection of the flow are in balance. However, flows within boundary layers near endwalls are of small kinetic energy and hence are carried from the pressure surface F toward the suction surface B under the force due to the pressure gradient as indicated by the arrows J. In the latter part of their path, these flows collide with the suction surface B and turn up to form two vortices W. The vortices W cause a low-energy fluid to be accumulated in the boundary layers near the endwalls, producing an non-uniform flow distribution having two loss peaks downstream of the blades, as shown in FIG. 2 of the accompanying drawings. While the non-uniform flow is finally mixed out to uniform downstream of the blades, it brings about a large energy loss.

It has been proposed to suppress the above secondary flow for increasing turbine performance by providing an inclined or curved surface across the entire blade height. However, controlling the secondary flow according to the proposal is not effective unless the blades are largely inclined or curved, and the largely inclined or curved blades often result in a problem in terms of mechanical strength especially if the blades are rotor blades.

Heretofore, high- and medium-pressure turbines have been designed two-dimensionally. With the development of computers and flow analysis technology, however, three-dimensional blade configurations are made applicable to those high- and medium-pressure turbines. The three-dimensional blade configurations make it possible to perform three-dimensional control on a loading distribution on blades which is given as the pressure difference between the pressure and suction surfaces of blades, and to reduce an energy loss of the blades. According to the conventional three-dimensional blade design, a plurality of twodimensional blade profiles at a certain blade height are designed and stacked along the blade height, thus defining three-dimensional blades. Consequently, it is not possible to control the pressure distribution in detail on the blades fully across the blade height for reducing an energy loss.

SUMMARY OF THE INVENTION

It is therefore an object of the present invention to provide a turbine device having blades whose loading distribution is three-dimensionally controlled for reducing an energy loss.

According to the present invention, there is provided a turbine device comprising a rotor having a plurality of turbine blades disposed between an inner-dimeter surface and an outer-diameter surface, the turbine blades being of a front or intermediate loaded type near the inner-diameter surface and of a rear loaded type near the outer-diameter surface.

Specifically, the turbine blades are of the front or intermediate loaded type near the inner-diameter surface and of the rear loaded type near the outer-diameter surface by three-dimensionally imparting a distribution of rates of change of circumferential velocity in the turbine blades.

Details of how the present invention has been made will be described below.

The inventors have focused on how best results can be achieved by finding such a position in the meridional direction in a flow path defined by turbine rotor blades, that the turbine rotor blades receive the greatest energy from the fluid, i.e., a position for the greatest load on the turbine rotor blades, at different blade heights. For an easier analysis, the flow path is divided into a front zone, an intermediate zone, and a rear zone along the meridional direction.

Work done by the turbine rotor blades is given as a change in a circumferential component Vθ of the absolute velocity at the rotor blade inlet and outlet, as shown in FIG. 3 of the accompanying drawings. The change in the circumferential component Vθ between the rotor blades is related to a loading distribution that is given as a pressure difference or enthalpy difference between pressure and suction surfaces of the rotor blades, according to the following equations:

For an incompressible flow:

$$\text{Loading distribution}=Pp-Ps=(2\pi/B)\rho W(\partial r\cdot V\theta/\partial m)$$

For a compressible flow:

$$\text{Loading distribution}=hp-hs=(2\pi/B)W(\partial r\cdot V\theta/\partial m)$$

where Pp, Ps represent static pressure respectively on the pressure and suction surfaces, hp, hs static enthalpy respectively on the pressure and suction surfaces, B the number of rotor blades of the turbine device, ρ the fluid density, W the average value of speeds on the pressure and suction surfaces, and (∂r·Vθ/∂m) the rate of change of the circumferential velocity Vθ between the rotor blades with respect to the axial distance m. These equations indicate that the loading distribution on the turbine rotor blades is related to the rate of change of the circumferential velocity, and that the loading distribution can be controlled by the value of the rate of change of the circumferential velocity. Specifically, if the rate of change of the circumferential velocity increases at an arbitrary position between the rotor blades, the blade surface load (Pp−Ps) or (hp−hs) increases at that position.

Therefore, the blade loading is related to the rate of change of the circumferential velocity in the axial direction of the turbine rotor blades according to the above equations. If the positive direction of the circumferential component Vθ is defined as the direction in which the rotor blades rotate, then since the circumferential component Vθ decreases from the rotor blade inlet toward the rotor blade outlet in the flow path between the rotor blades, the rate of change of the circumferential component Vθ becomes a negative value. FIG. 4 of the accompanying drawings shows a distribution of rates of change of the circumferential component between the turbine rotor blades. Since, in general, the rate of change of the circumferential component decreases in a certain range from the rotor blade inlet, is substantially constant in an intermediate range, and increases in a rear range, there are two boundary values A, B (hereinafter referred to as branch control points) on the distribution. As shown in FIG. 5 of the accompanying drawings, a distribution of rates of change of the circumferential component where two branch control points A1, B1 are present in a front zone of the flow path in the meridional direction is referred to as a front loaded type, a distribution of rates of change of the circumferential component where a first branch control point A2 is present in the front zone of the flow path in the meridional direction and a second branch control point B2 is present in a rear zone of the flow path in the meridional direction is referred to as an intermediate loaded type, and a distribution of rates of change of the circumferential component where two branch control points A3, B3 are present in the rear zone of the flow path in the meridional direction is referred to as a rear loaded type.

When certain loading distributions (front, intermediate, and rear loaded types) were fixed in a mid-span and a tip of rotor blades, effects of loading distributions at a base of rotor blades as they were set to the front, intermediate, and rear loaded types as shown in FIG. 5 were inspected. Blades which are designed based on these loading distributions have cross-sectional profiles at their bases, as shown in FIG. 6 of the accompanying drawings. A computerized flow analysis of flows between turbine rotor blades whose bases have such cross-sectional profiles indicates that velocity vectors near the bases of the turbine rotor blades, i.e., at the inner-diameter surfaces thereof, are as shown in FIG. 7 of the accompanying drawings. It can be seen from FIG. 7 that a flow separation occurs in the middle of the flow path between the blades of the rear loaded type. The flow separation produces a strong secondary flow from the pressure surface toward the suction surface. As shown in FIG. 8 of the accompanying drawings, an energy loss peak near the inner-diameter surfaces (or hub endwall surfaces) of the blades of the rear loaded type is greater than that of the front or intermediate loaded type. No significant difference exists between the energy loss peaks on the inner-diameter surfaces of the blades of the front and intermediate loaded types.

As shown in FIG. 9 of the accompanying drawings, if loading distributions are set to the front loaded type and the rear loaded type at the tip of the blades and the blades are designed based on such loading distributions in the same manner as described above, then the blades have cross-sectional profiles at their tip as shown in FIG. 10 of the accompanying drawings. When certain loading distributions (front, intermediate, and rear loaded types) were fixed in a mid-span and a base of rotor blades, loss distributions at the blade outlet of the blades of the front and rear loaded types at their tip were calculated. As a result, it has been found that the loss peak of the blades of the rear loaded type is smaller than that of the front loaded type, as shown in FIG. 11 of the accompanying drawings. This is because the suction surface of the blades of the front loaded type is long downstream of the throat of the rotor blade outlet, so that the boundary layer is developed greater than with the blades of the rear loaded type. It is known that in the middle of the blades along their height, the blades exhibit intermediate characteristics between those at their base and tip.

From the above results, it can be understood that turbine blades which can suppress a secondary flow and suffer a smallest energy loss are of the front or intermediate loaded type at their base and of the rear loaded type at their tip. The inventors have designed a turbine having such characteristics.

The above and other objects, features, and advantages of the present invention will become apparent from the following description when taken in conjunction with the accompanying drawings which illustrate a preferred embodiment of the present invention by way of example.

DETAILED DESCRIPTION OF THE PREFERRED EMBODIMENT

Figure 1:
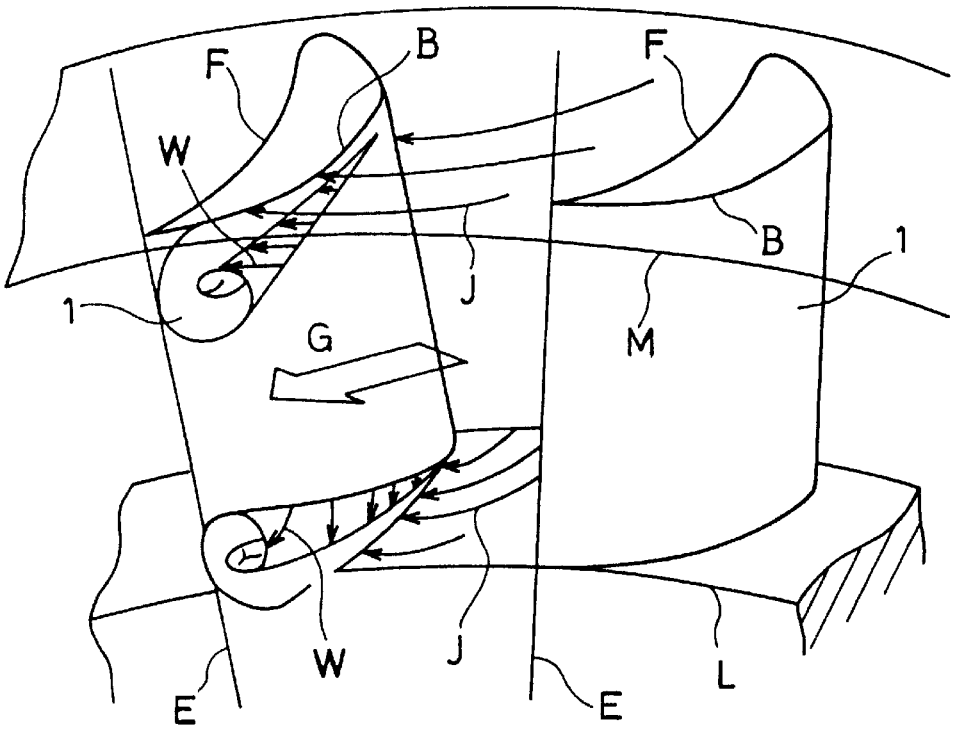
FIG. 1 PRIOR ART
FIG. 1 is a schematic fragmentary perspective view illustrative of the generation of a flow loss on conventional turbine rotor blades.
Figure 2:
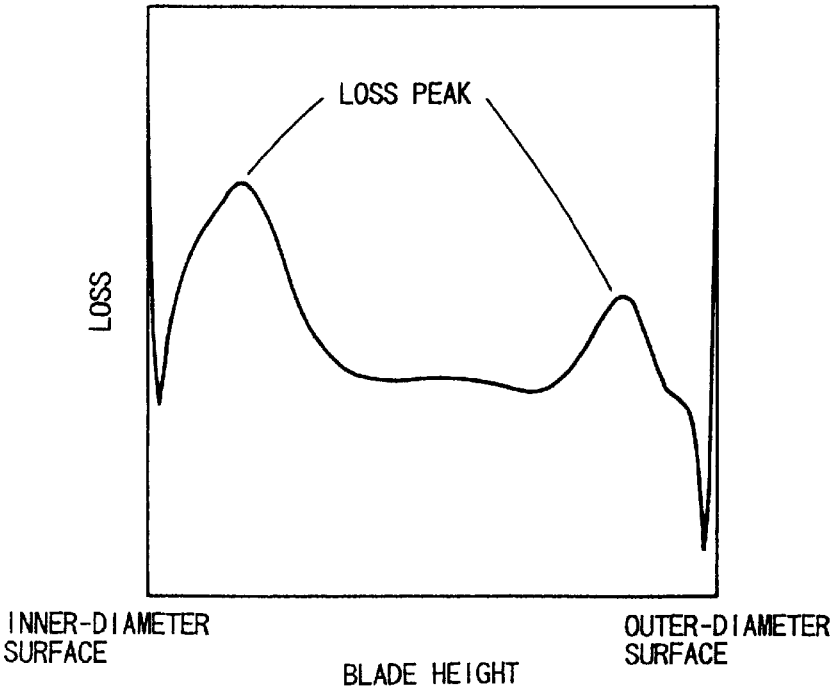
FIG. 2 PRIOR ART
FIG. 2 is a graph of a distribution of losses on conventional turbine rotor blades.
Figure 3:
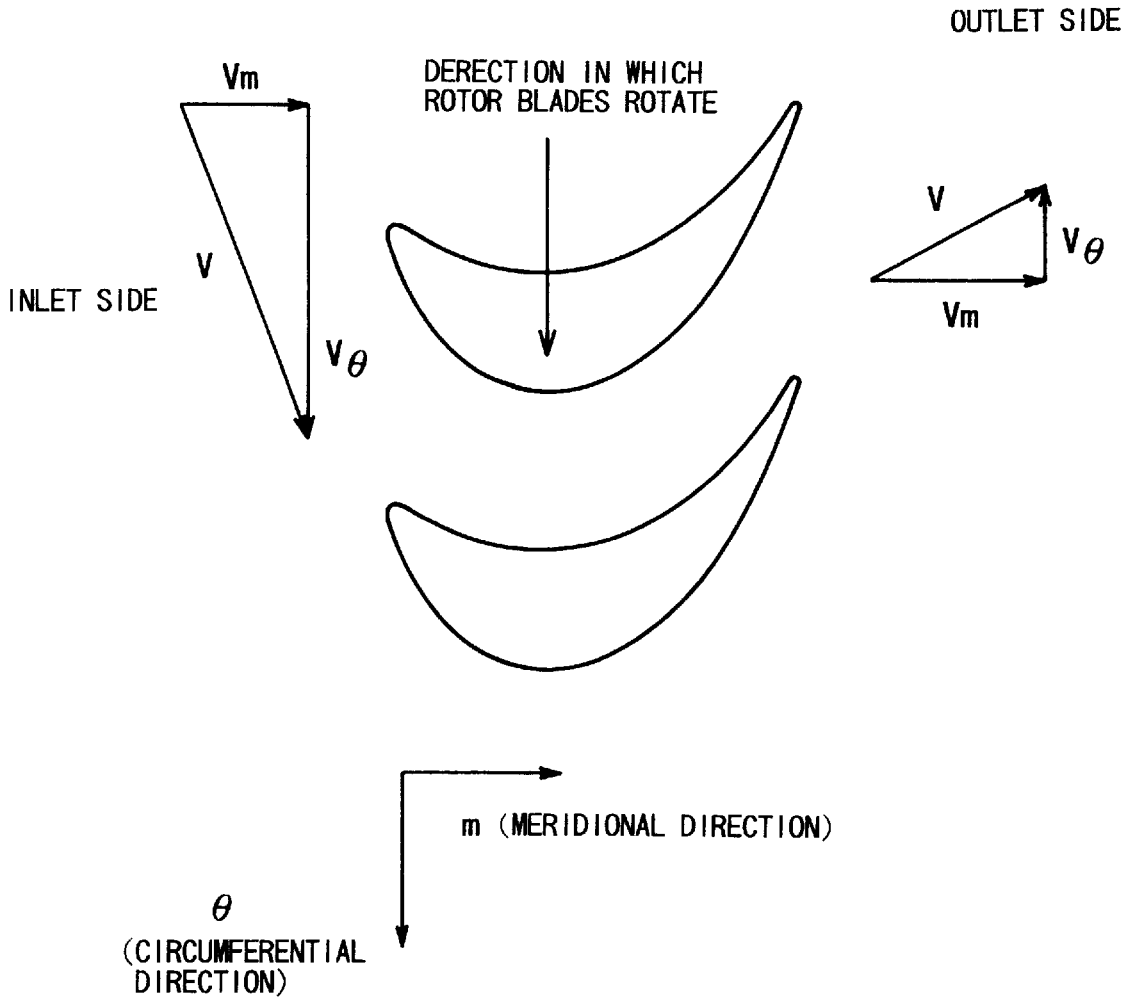
FIG. 3 is a diagram illustrative of work done by turbine rotor blades.
Figure 4:
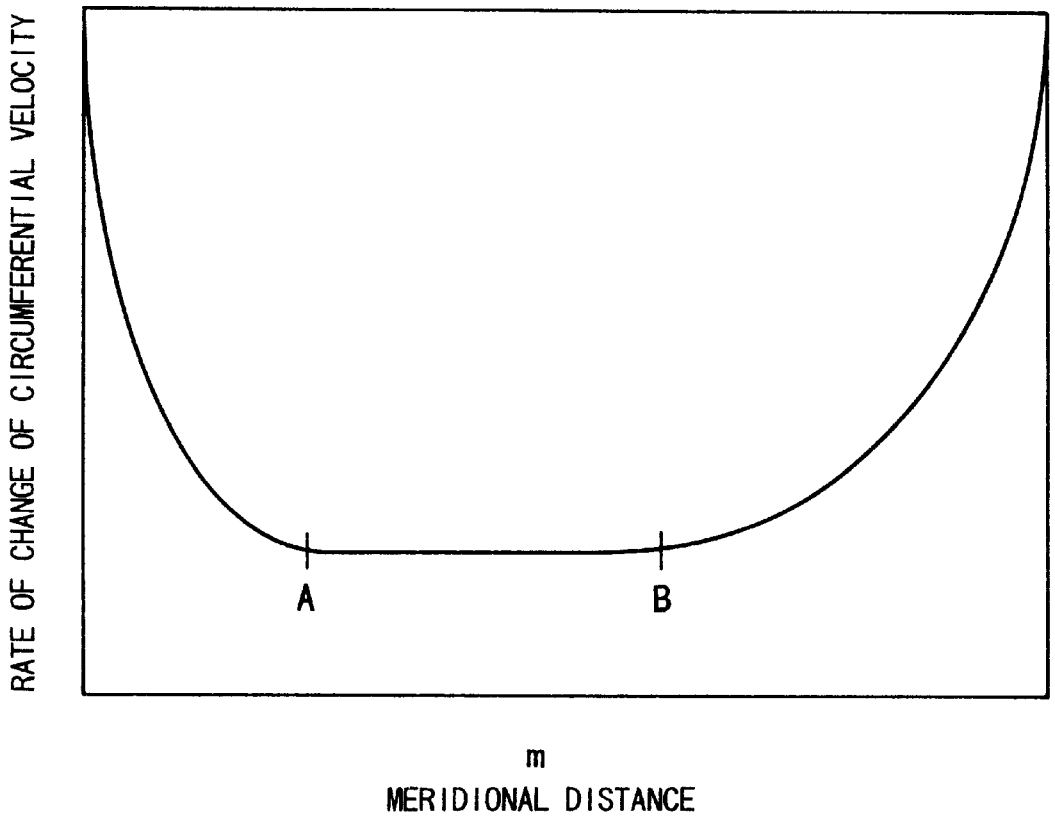
FIG. 4 is a graph showing a distribution of rates of change of circumferential velocity between conventional turbine rotor blades.
Figure 5:
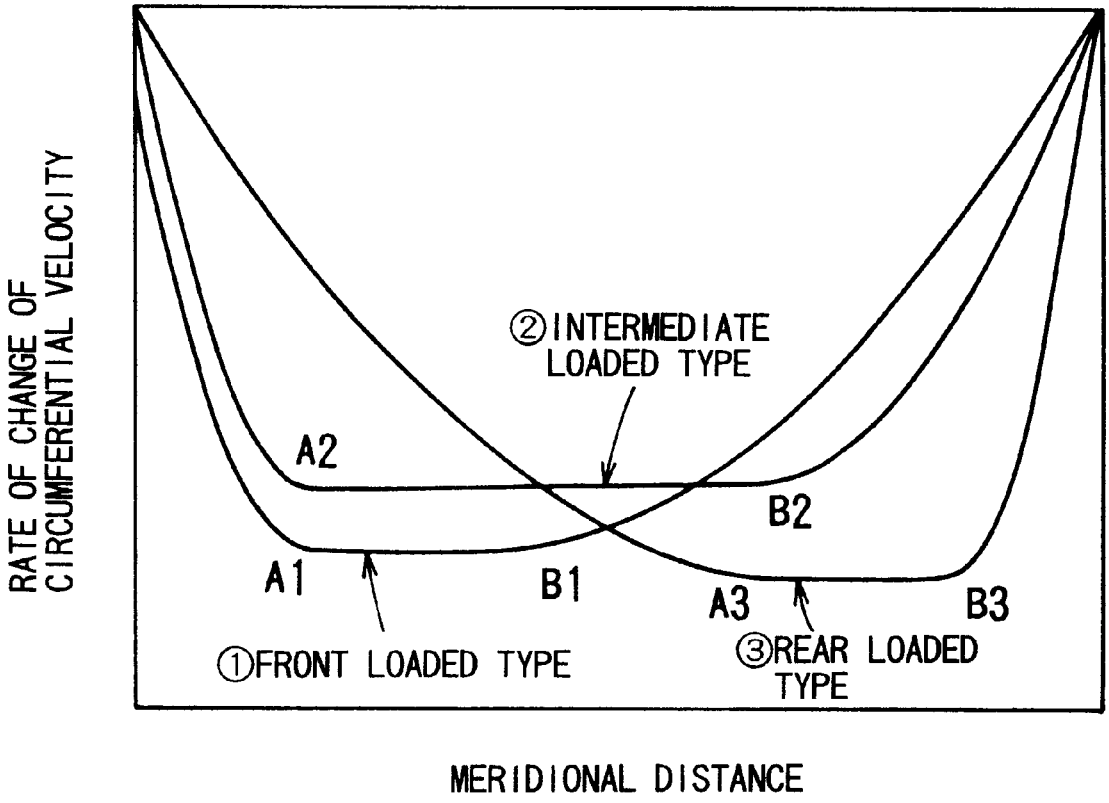
FIG. 5 is a graph showing types of distributions of rates of change of circumferential velocity between conventional turbine rotor blades at the hub.
Figure 6:
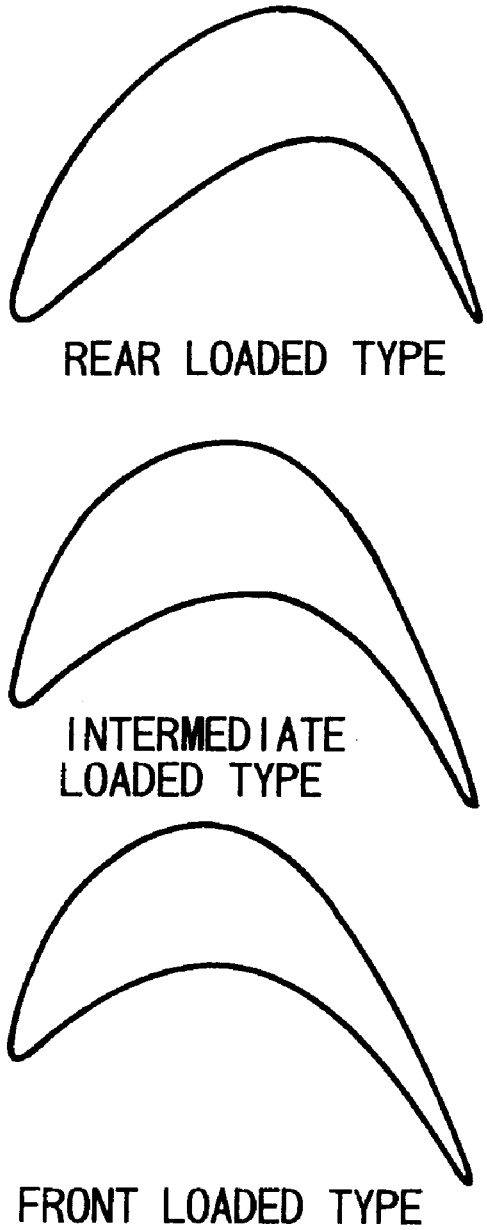
FIG. 6 is a diagram showing cross-sectional profiles of blades at their base which have been designed based on the loading distributions shown in FIG. 5.
Figure 7:
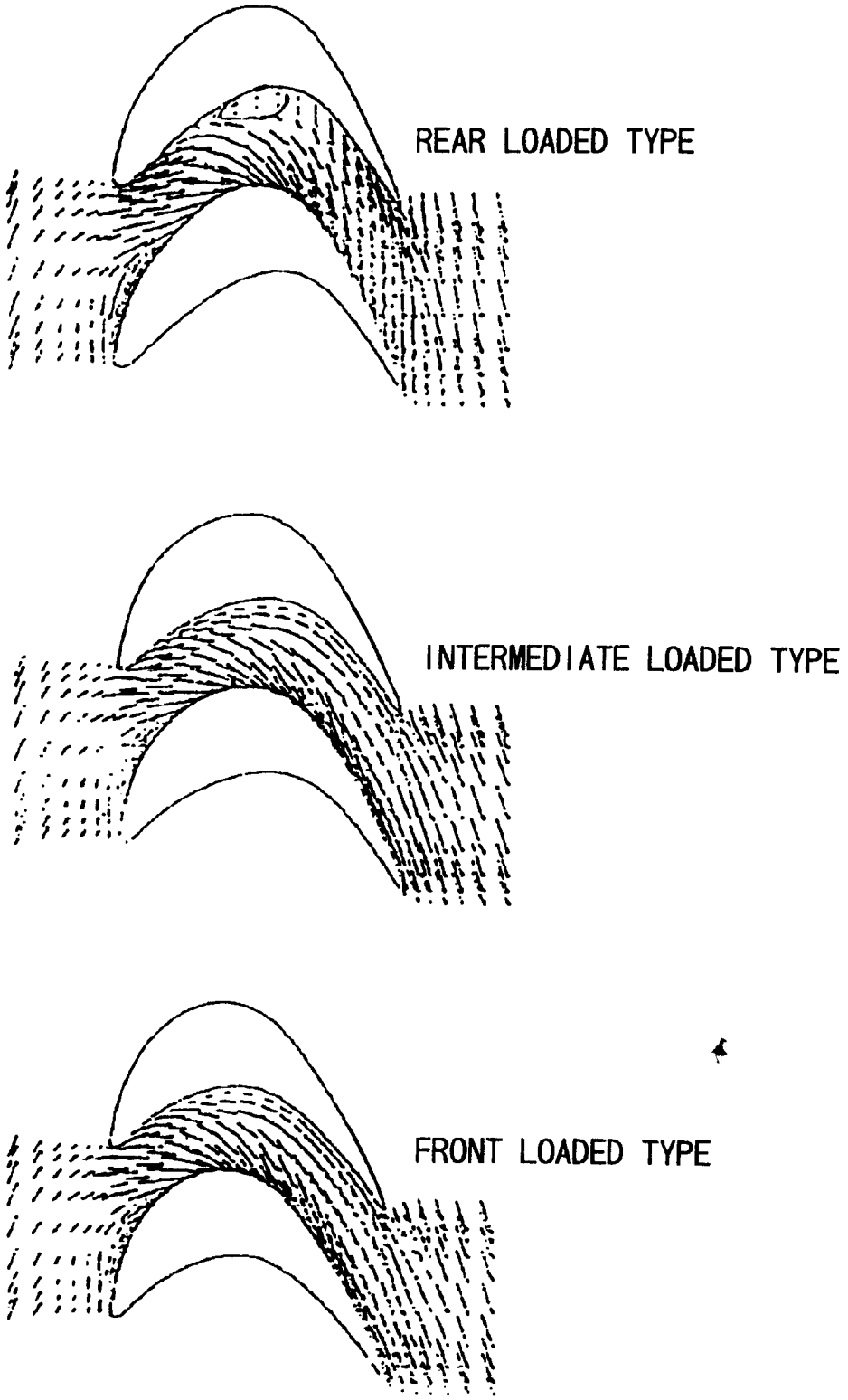
FIG. 7 is a diagram showing the results of an analysis of flows between the turbine rotor blades having the cross-sectional profiles shown in FIG. 6.
Figure 8:
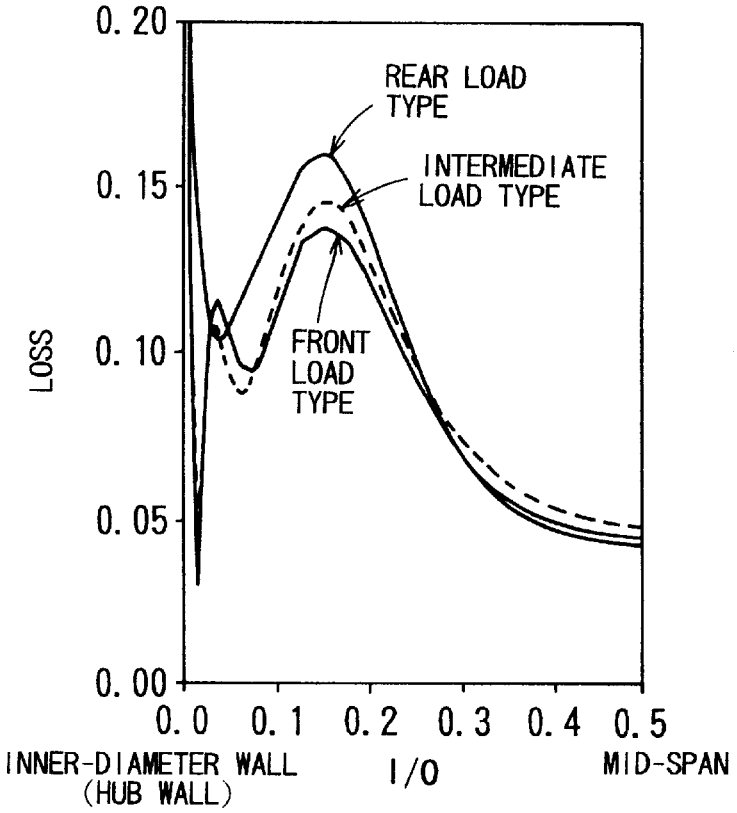
FIG. 8 is a graph showing loss distributions in turbines whose turbine rotor blades have the cross-sectional profiles shown in FIG. 6.
Figure 9:
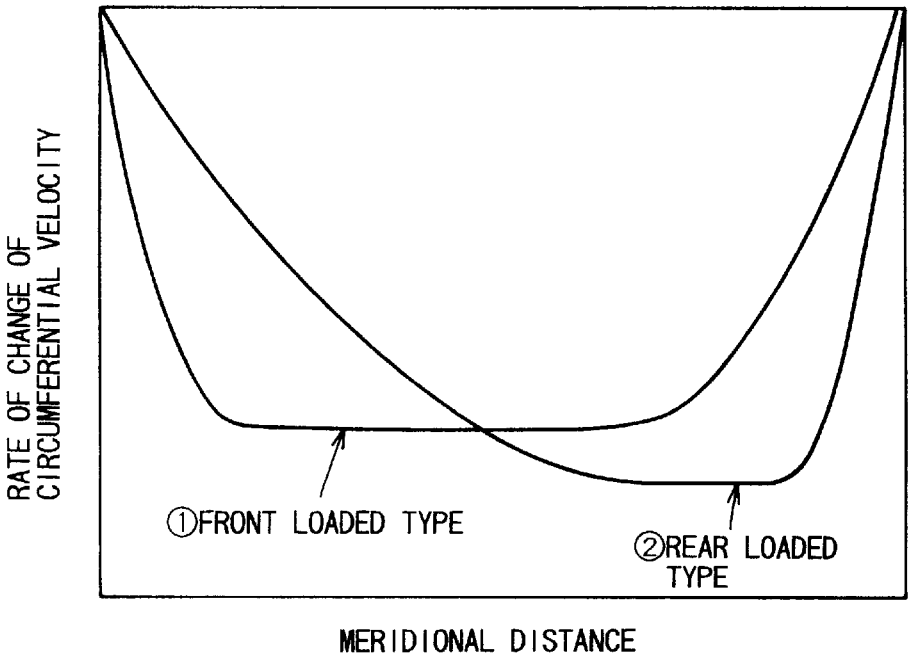
FIG. 9 is a graph showing types of distributions of rates of change of circumferential velocity between conventional turbine rotor blades at their tip.
Figure 10:
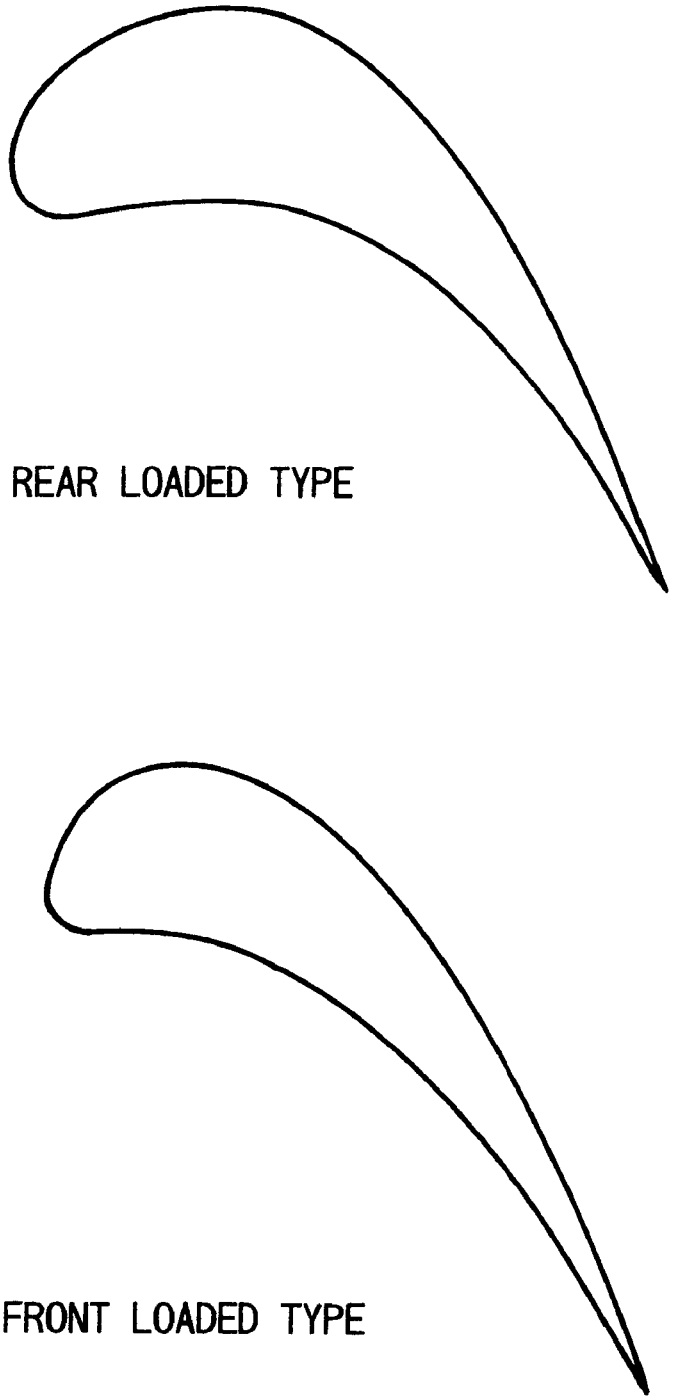
FIG. 10 is a diagram showing cross-sectional profiles of blades at their tip which have been designed based on the loading distributions shown in FIG. 9.
Figure 11:
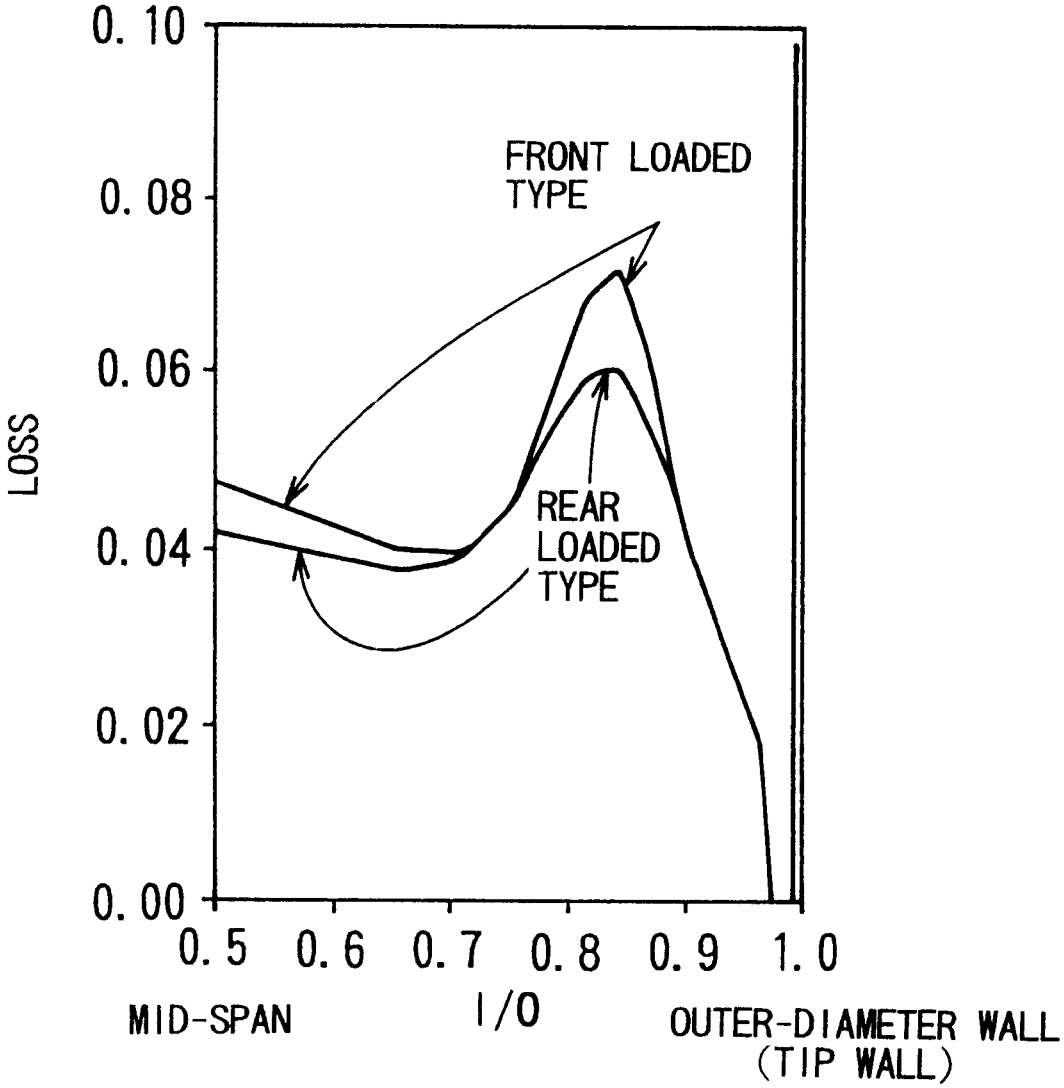
FIG. 11 is a diagram showing the results of an analysis of flows between the turbine rotor blades having the cross-sectional profiles shown in FIG. 10.
Figure 12:
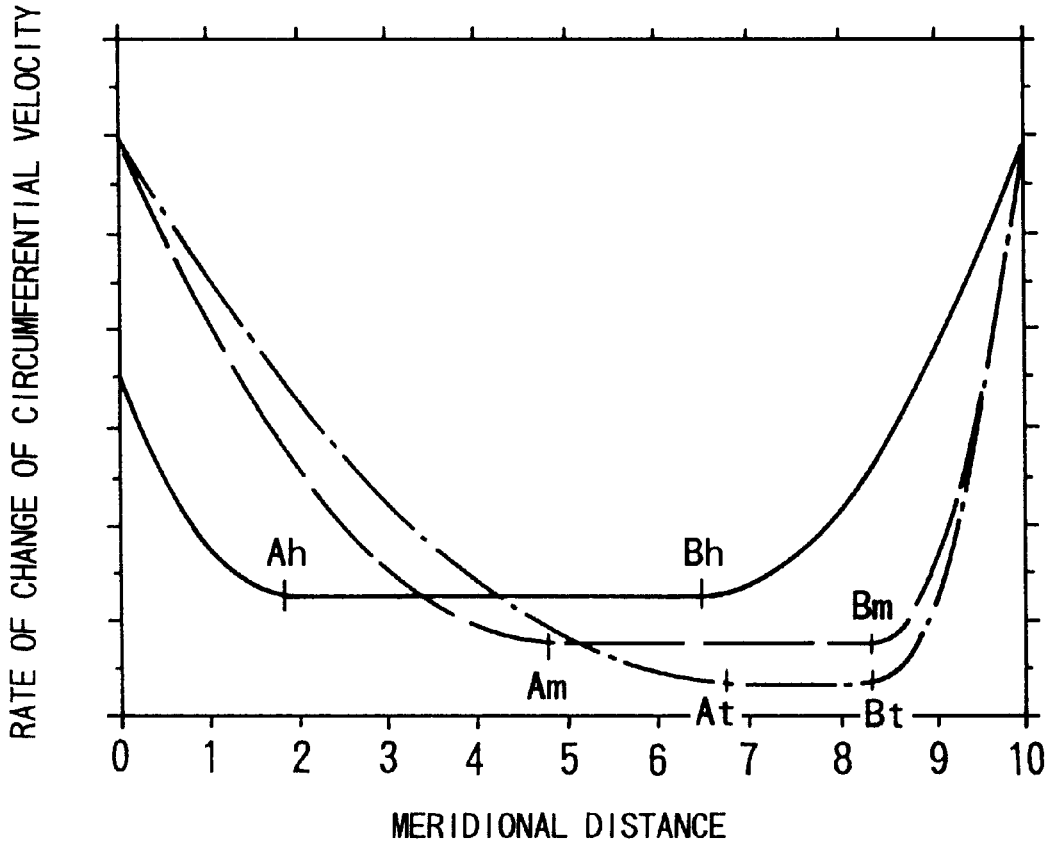
FIG. 12 is a graph showing loading distributions according to an embodiment of the present invention.

A turbine device according to an embodiment of the present invention will be described below in detail. FIG. 12 shows loading distributions established based on the above concept with respect to a turbine device where the ratio of the diameters of hub and tip is 1.33. Turbine blades are of an intermediate loaded type at their hub with a first branch control point Ah at about 17% of the meridional distance and a second branch control point Bh at about 65% of the meridional distance. The turbine blades are of a rear loaded type at their tip with a first branch control point At at about 70% of the meridional distance and a second branch control point Bt at about 83% of the meridional distance. The turbine blades are of an intermediate rear loaded type at their middle point (mid-span) between their hub and tip with a first branch control point Am at about 47% of the meridional distance and a second branch control point Bm at about 83% of the meridional distance.

Figure 13:
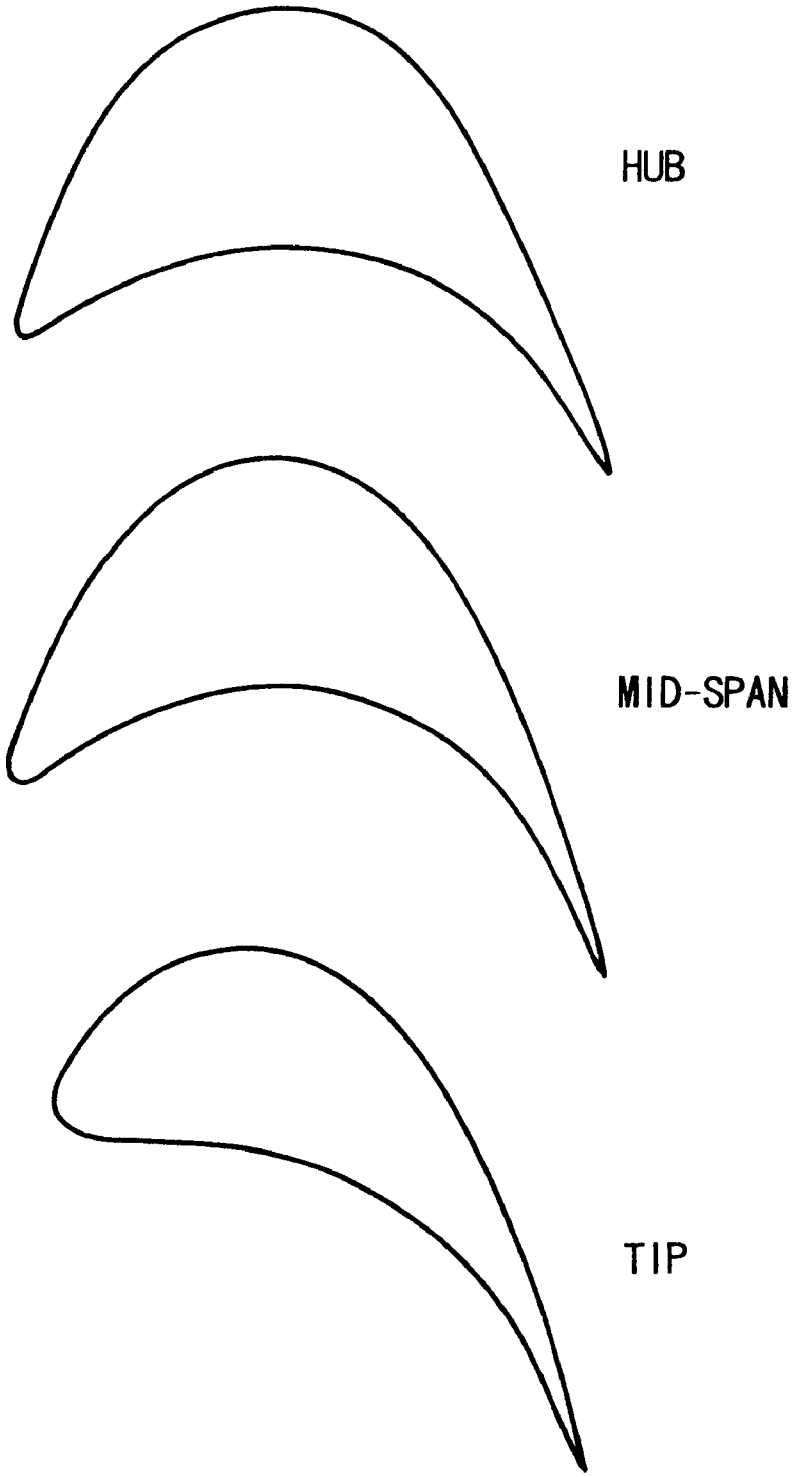
FIG. 13 is a diagram showing blade profiles according to the embodiment of the present invention.

Loading distributions on the entire blades are interpolated from the loading distributions thus established at the hub, middle span, and tip of the blades. Therefore, when the loading distributions are thus established at the hub, mid-span, and tip of the blades, the loading distributions on the entire blades can appropriately be established three-dimensionally. The turbine blades have cross-sectional profiles at their hub, mid-span, and tip as shown in FIG. 13.

Figure 14:
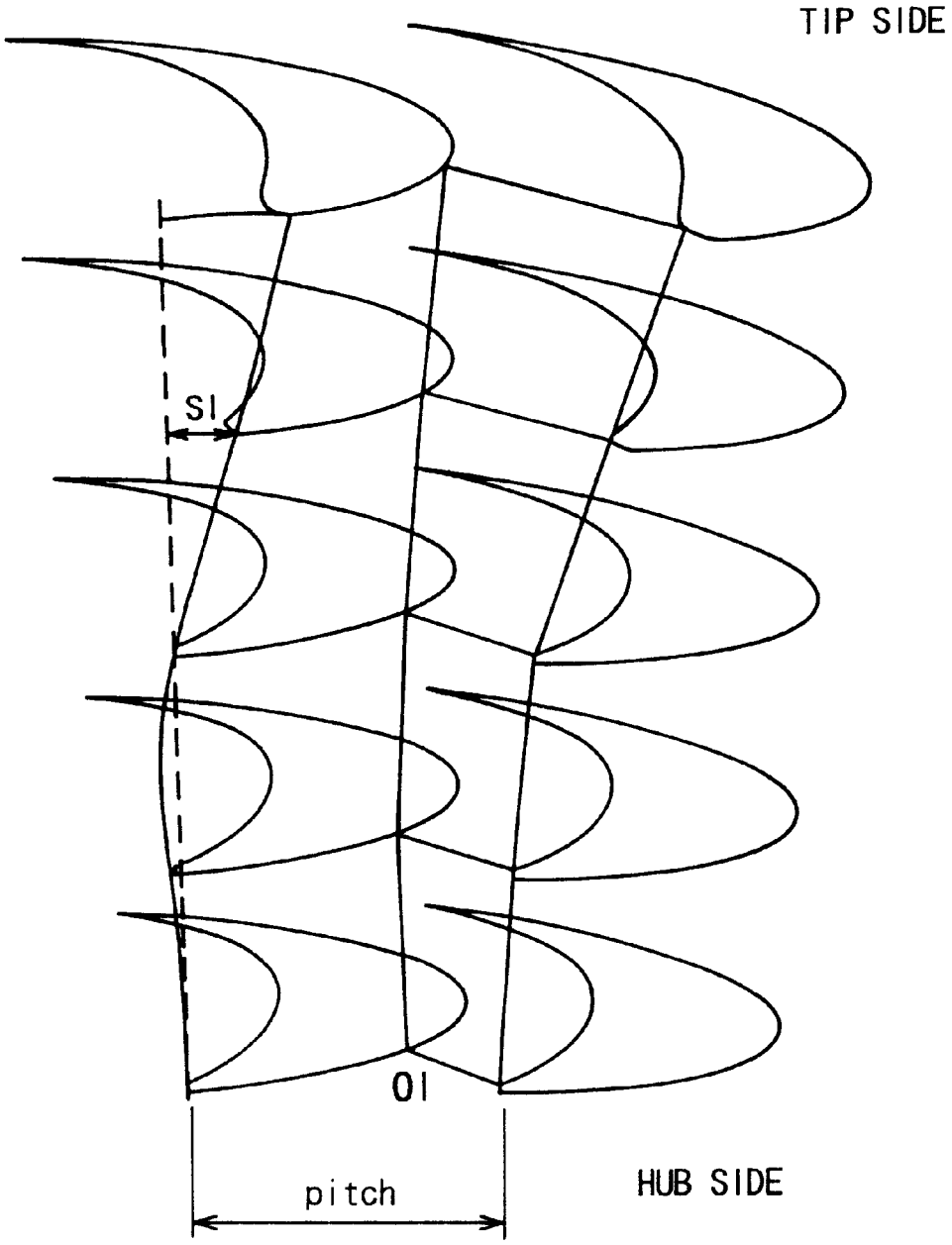
FIG. 14 is a diagram showing three-dimensional blade profiles according to the embodiment of the present invention.
Figure 15:
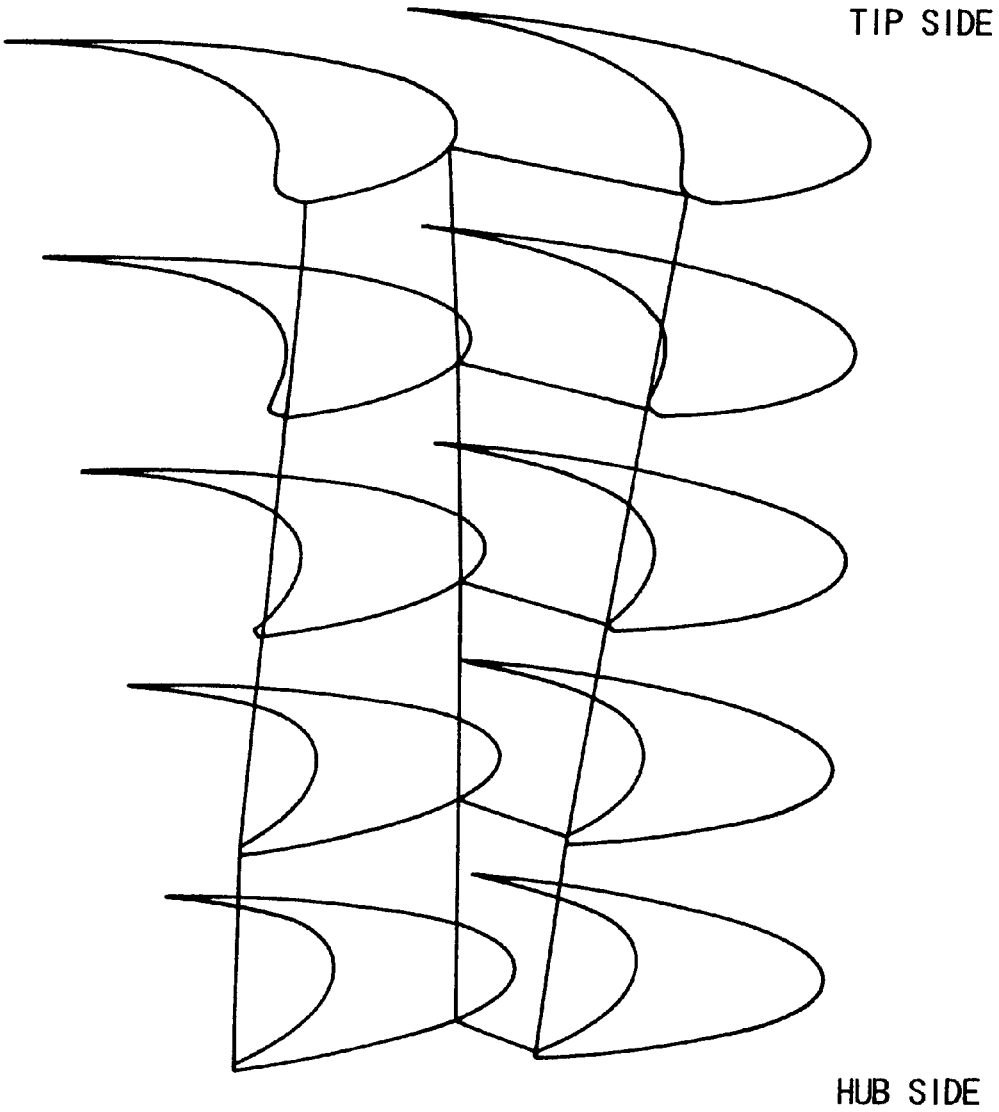
FIG. 15 is a diagram showing conventional three-dimensional blade profiles.

FIG. 14 shows three-dimensional blade profiles produced when different maximum load positions are established across the flow path from the hub to the tip and greater work is to be done near the mid-span than at the hub and the tip where the boundary layer has a greater effect. In FIG. 14, the turbine rotor blades are viewed downstream with respect to the fluid flow. It can be seen from FIG. 14 that the inlet edge is curved along the radial direction. In FIG. 14, S1 represents the circumferential distance between the rotor blade inlet edge at the inner-diameter surface and blade inlet edges at each of radial positions. FIG. 15 shows a comparative example of conventional three-dimensional blade profiles whose loading distributions are not controlled three-dimensionally.

Figure 16:
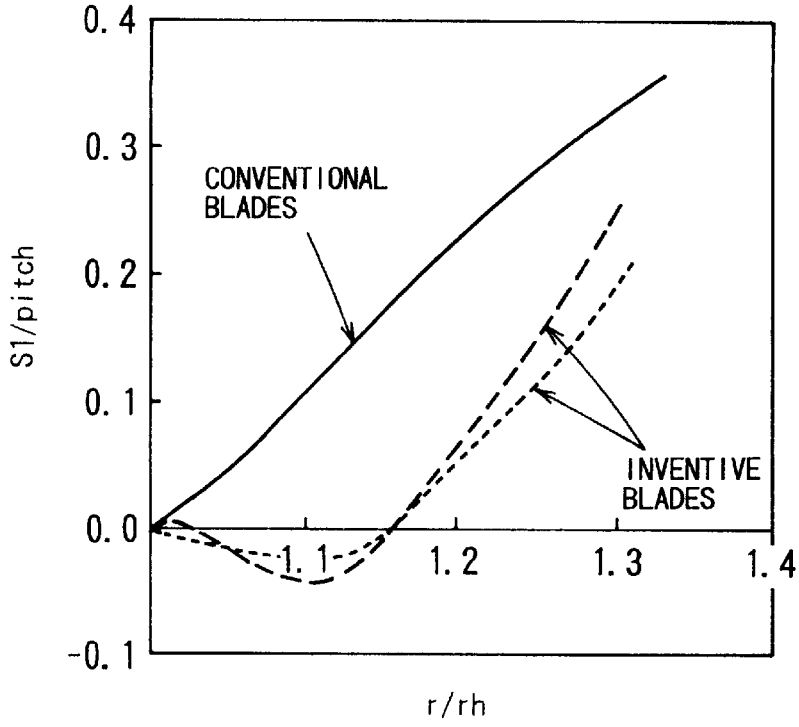
FIG. 16 is a graph showing radial changes in the circumferential distance between a rotor blade inlet edge at an inner-diameter surface and rotor blade inlet edges at each of radial positions.

FIG. 16 shows radial changes of the value S1/pitch which has been made dimensionless by the blade pitch. With the rotor blade according to the present invention, on the basis of the rotor blade inlet edge on the inner-diameter surface, the rotor blade inlet edge is located in the opposite direction in which the rotor blades rotate, in a range of the ratio $r/rh<1.15$. The ratio r/rh is defined as a ratio of the diameter to the inner diameter of the rotor blade. The rotor blade inlet edge is located in the same direction in which the rotor blades rotate, in a range of $1.15<r/rh$.

Figure 17:
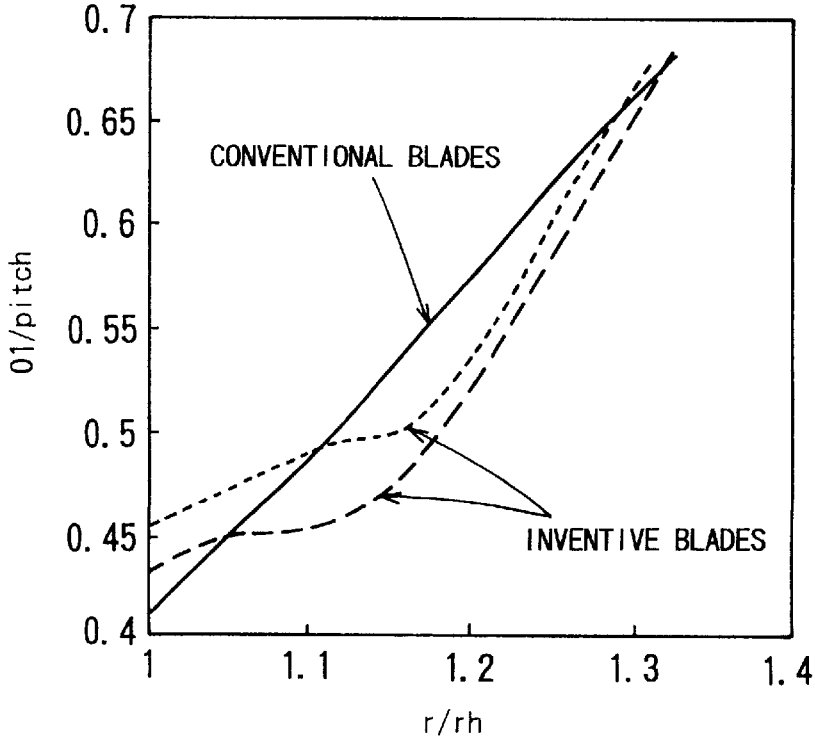
FIG. 17 is a graph showing radial changes of the width of a throat at a rotor blade inlet.

As shown in FIG. 17, the distance O1 in the throat of the blade inlet of the conventional blades increases at a substantially constant rate from the inner-dimeter surface to the outer-diameter surface. With the rotor blades according to the present invention, the rate of increase of the value O1/pitch which has been made dimensionless by the blade pitch is about 0.45 in a range of the ratio $r/rh<1.15$, and about 1.3 and increases monotonously along the radial direction in a range of $1.15<r/rh$.

The turbine device according to the present invention is therefore capable of reducing a flow loss and is of high efficiency and performance based on the three-dimensionally control of loading distributions on the blades.

Although a certain preferred embodiment of the present invention has been shown and described in detail, it should be understood that various changes and modifications may be made therein without departing from the scope of the appended claims.

What is claimed is:

1. A turbine device comprising a rotor having a plurality of turbine blades disposed between an inner-diameter surface and an outer-diameter surface, the turbine blades being of a front or intermediate loaded type near the inner-diameter surface and of a rear loaded type near the outer-diameter surface and an inlet edge of each of the turbine blades being curved along a radial direction.

2. A turbine device according to claim 1, wherein a distribution of rates of change of circumferential velocity in a meridional direction of the turbine blades at the inner-diameter surface thereof, decreases in a range of 0 to 20% of a meridional distance of the turbine blades, is substantially constant in a range of 20 to 50% of the meridional distance of the turbine blades, and increases to zero in a range of 50 to 100% of the meridional distance of the turbine blades.

3. A turbine device according to claim 2, wherein the distribution of rates of change of circumferential velocity in the meridional direction of the turbine blades at the mid-span thereof, decreases in a range of 0 to 50% of a meridional distance of the turbine blades, is substantially constant in a range of 50 to 70% of the meridional distance of the turbine blades, and increases to zero in a range of 70 to 100% of the meridional distance of the turbine blades.

4. A turbine device according to claim 2, wherein the distribution of rates of change of circumferential velocity in the meridional direction of the turbine blades at an outer-diameter surface thereof, decreases in a range of 50 to 70% of a meridional distance of the turbine blades, and increases to zero in a range of 70 to 100% of the meridional distance of the turbine blades.

5. A turbine device, comprising:

a rotor having a plurality of turbine blades disposed between an inner-diameter surface and an outer-diameter surface; and a ratio of the diameter of the inner-diameter surface and the outer-diameter surface ranging from 1.2 to 1.4;

wherein the rotor blade inlet edge is located, on the basis of the rotor blade inlet edge on the inner-dimeter surface, in the opposite direction in which the rotor blades rotate, in a range of $r/rh<1.15$, and in the same direction in which the rotor blades rotate, in a range of $1.15<r/rh$;

whereby r/rh is defined as a ratio of the diameter to the inner diameter of the rotor blade.

6. A turbine device, comprising:

a rotor having a plurality of turbine blades disposed between an inner-diameter surface and an outer-diameter surface; and a ratio of the diameter of the inner-diameter surface and outer-diameter surface ranging from 1.2 to 1.4;

wherein a rate of radial change of the width of a throat in a flow path at a rotor blade inlet, is of a constant value of about 0.45 in a range of $r/rh<1.15$, and of another constant value of about 1.3 in a range of $1.15<r/rh$;

whereby r/rh is defined as a ratio of the diameter to the inner diameter of the rotor blade.

* * * * *